US006826979B2

(12) United States Patent
Dybro

(10) Patent No.: US 6,826,979 B2
(45) Date of Patent: Dec. 7, 2004

(54) FORCE BALANCE CONDITION MINIMIZER FOR AN OPERATING LEVER

(75) Inventor: Niels Dybro, Reinbeck, IA (US)

(73) Assignee: Deere & Company, Moline, IL (US)

( * ) Notice: Subject to any disclaimer, the term of this patent is extended or adjusted under 35 U.S.C. 154(b) by 223 days.

(21) Appl. No.: 10/289,518

(22) Filed: Nov. 6, 2002

(65) Prior Publication Data

US 2004/0083848 A1 May 6, 2004

(51) Int. Cl.[7] ..... G05G 5/06
(52) U.S. Cl. ..... 74/527; 74/473.3
(58) Field of Search ..... 74/473.25, 473.3, 74/471 XY, 517, 527, 575

(56) References Cited

U.S. PATENT DOCUMENTS

| | | | | |
|---|---|---|---|---|
| 2,836,082 A | | 5/1958 | Miner | 74/527 |
| 3,059,497 A | | 10/1962 | Eadie | 74/527 |
| 3,765,261 A | | 10/1973 | Hobbins | 74/477 |
| 3,827,649 A | * | 8/1974 | Payen | 242/296 |
| 4,119,119 A | | 10/1978 | Ballendux et al. | 137/868 |
| 4,338,828 A | | 7/1982 | Ruhlman | 74/475 |
| 4,977,789 A | | 12/1990 | Osborn | 74/475 |
| 5,277,078 A | | 1/1994 | Osborn et al. | 74/475 |
| 5,289,734 A | * | 3/1994 | Parsons | 74/473.21 |
| 6,109,130 A | | 8/2000 | Will | 74/470 |
| 6,192,770 B1 | * | 2/2001 | Miyoshi et al. | 74/473.18 |

* cited by examiner

*Primary Examiner*—Chong H. Kim

(57) ABSTRACT

A detent mechanism is provided for minimizing the force balance condition of an operating lever assembly. The detent mechanism has a detent housing with first and second detent members disposed therein. Means are provided for biasing the first detent member against rotation. The second detent member frictionally engages the first detent member while being capable of movement relative thereto. The second detent member is also disposed for selective engagement of detent notches provided on the first detent member, whereby movement of the second detent member with and relative to the first detent member causes the first detent member to rotate in a first direction until the means for biasing exerts enough force on the first detent member to cause the first detent member to rotate in a second direction causing the second detent member to engage an adjacent detent notch of the first detent member.

25 Claims, 2 Drawing Sheets

FORCE BALANCE CONDITION MINIMIZER FOR AN OPERATING LEVER

FIELD OF THE INVENTION

The device disclosed herein relates generally to operating lever assemblies as are frequently used to select an operating mode of another device. More particularly, the device disclosed herein relates to detent mechanisms used in such operating levers to facilitate positive engagement in the desired position. Specifically, the device disclosed herein relates to such a mechanism having means to eliminate perching of the detent mechanism between desired positions.

BACKGROUND OF THE INVENTION

Operating lever assemblies are frequently used to select operating modes of other devices and are often subject to vibration as work is performed. For obvious reasons it is desired that when the operator selects a desired position for an operating mode he or she is assured, despite vibrations, that the position chosen is obtained and will remain the same until another position is selected. Previously it has been known to utilize various types of detent mechanisms to accomplish and maintain the positive engagement of the lever in the selected position. One commonly used detent arrangement comprises a spring loaded ball or roller frictionally biased against a structure having receiving grooves, humps, or holes. Ordinarily, as the lever is moved from one position to another, the roller or ball will ride up the hump, compressing the spring until such movement allows the spring biased roller or ball to obtain the adjacent nested position. Under most circumstances selection of the desired position is accomplished in response to the directional movement of the lever and the frictional feedback from the detent. However, under certain circumstances the roller or ball will perch in a zone around the apex of the hump due to the fact that the tangential force component from the spring loaded ball or roller acting on the structure approaches the frictional force between the ball or roller and the structure, as the ball or roller nears the apex. This force balance condition is undesirable and can be unsafe inasmuch as the positive engagement of the detent in the desired position has not been accomplished. Accordingly, there is a clear need in the art for an improved detent mechanism which is effective to minimize the force balance condition and thereby eliminate the perching problem so as to allow the operating lever to be consistently positively engaged and maintained in the desired operating position.

SUMMARY OF THE INVENTION

In view of the foregoing, it is an object of the invention to provide an operating lever for selecting an operating mode of another device.

Another object of the invention is the provision of such an operating lever having a detent mechanism for positively engaging and maintaining a selected operating position.

A further object of the invention is to provide such an operating lever having means to minimize the force balance condition of the detent mechanism to eliminate perching.

An additional object of the invention is the provision of such an operating lever which provides a positive feel for operator feedback, including sound and force direction and is not vibration sensitive.

Still another object of the invention is to provide such a lever which is adaptable to a variety of applications.

The foregoing and other objects of the invention together with the advantages thereof over the known art which will become apparent from the detailed specification which follows are attained by a detent mechanism for an operating device assembly comprising: a detent housing; a first detent member having a plurality of adjacent detent notches therein with an apex between adjacent detent notches, the first detent member being rotatably disposed within the detent housing; means for biasing the first detent member against rotation; and, a second detent member frictionally engaging the first detent member, the second detent member being capable of movement relative to the first detent member and of selectively engaging the detent notches of the first detent member; whereby movement of the second detent member causes the first detent member to rotate in a first direction until the means for biasing exerts enough force on the first detent member to limit rotation of the first detent member in the first direction allowing the second detent member to move relative to the first detent member thereby unseating the second detent member from a detent notch and allowing the second detent member to move onto an apex between detent notches at which time the means for biasing exerts enough force on the first detent member to cause the first detent member to rotate in a second direction so as to cause the second detent member to engage an adjacent detent notch of the first detent member.

Other objects of the invention are attained by a detent mechanism for an operating lever assembly comprising: a spring; a detent plate having at least two legs extending there from and a plurality of adjacent detent notches therein with an apex between adjacent detent notches, the detent plate being disposed for limited rotational movement relative to the spring; and, a detent element biased against the detent plate, the detent element being capable of movement relative to the detent plate; whereby movement of the detent element causes limited rotational movement of the detent plate relative to the spring in a first direction bringing one of the legs into biased engagement with the spring until as the detent element approaches the apex between adjacent detent notches the bias force exerted upon the leg by the spring rotates the detent plate in an opposite direction causing the detent element to engage an adjacent detent notch.

Still other objects of the invention are attained by a detent mechanism for an operating lever assembly comprising: a main housing; a yoke mountably disposed within the main housing the yoke having a pair of standards and a bolster; a detent plate rotatably disposed within the yoke, the detent plate having at least two legs extending there from and a plurality of adjacent detent notches therein with an apex between the adjacent detent notches; a leaf spring supported by the standards of the yoke and interposed between the bolster of the yoke and the detent plate; and, a roller frictionally biased against the detent plate in the vicinity of the plurality of adjacent detent notches, the roller being capable of selective movement relative to the detent plate so as to enable the roller to frictionally engage individual detent notches; whereby movement of the roller causes the detent plate to rotate in a first direction within the yoke, bringing one of the legs of the detent plate into contact with the leaf spring such that continued rotation of the detent plate in the first direction causes the leaf spring to bias the detent plate in a second direction until as the roller approaches an apex between adjacent detent notches the leaf spring forces the detent plate in the second direction causing the roller to engage an adjacent detent notch.

Still further objects of the invention are attained by an operating lever assembly comprising: a main housing; a yoke mountably disposed within the main housing, the yoke having a pair of standards and a bolster; an actuator housing pivotally mounted to the yoke and movably disposed within the main housing; an operating lever operatively connected to the actuator housing; a detent plate rotatably mounted in the yoke, the detent plate having a pair of legs and a plurality of adjacent detent notches with an apex between each of the adjacent detent notches; a leaf spring having first and second ends, the leaf spring being interposed between the detent plate and the bolster of the yoke with the ends thereof being supported by the standards of the yoke; a roller pivotally mounted in the actuator housing, the roller being disposed for selective engagement of the detent notches of the detent plate; a compression spring disposed within the actuator housing, the compression spring frictionally biasing the roller against the detent plate; whereby manipulation of the lever causes the actuator housing to move and also causes the detent plate to begin to rotate in a first direction due to the frictional engagement of the roller as the roller is being unseated from a detent notch, bringing one of the legs of the detent plate into engagement with the leaf spring such that continued rotation of the detent plate causes the leaf spring to bias the detent plate in a second direction until as the roller approaches an apex between adjacent detent notches the leaf spring forces the detent plate in the second direction thereby causing the roller to nest in an adjacent detent notch.

Still other objects of the invention are attained by an operating lever assembly comprising: a main housing; a yoke mountably disposed within the main housing, the yoke having a pair of standards and a bolster; an actuator housing pivotally mounted to the yoke and movably disposed within the main housing; an operating lever operatively connected to the actuator housing; a detent plate mounted for limited rotational movement within the yoke, the detent plate having a pair of legs and a plurality of adjacent detent notches with an apex between each of the adjacent detent notches; a leaf spring having first and second ends, the leaf spring being interposed between the detent plate and the bolster of the yoke with the ends thereof being supported by the standards of the yoke; a roller pivotally mounted in the actuator housing, the roller being disposed for selective engagement of the detent notches of the detent plate; a compression spring disposed within the actuator housing, the compression spring frictionally biasing the roller against the detent plate; whereby manipulation of the lever causes the actuator housing to move and also causes the detent plate to begin to rotate in a first direction through a limited range due to the frictional engagement of the roller, bringing one of the legs of the detent plate into engagement with the leaf spring such that continued rotation of the detent plate causes the leaf spring to bias the detent plate in a second direction until as the roller is unseated from a detent notch and approaches an apex between adjacent detent notches the leaf spring forces the detent plate in the second direction thereby causing the roller to nest in an adjacent detent notch.

In general, a detent mechanism is provided for minimizing the force balance condition of an operating lever assembly. The detent mechanism has a detent housing with first and second detent members disposed therein. Means are provided for biasing the first detent member against rotation. The second detent member frictionally engages the first detent member while being capable of movement relative thereto. The second detent member is also disposed for selective engagement of detent notches provided on the first detent member, whereby movement of the second detent member with and relative to the first detent member causes the first detent member to rotate in a first direction until the means for biasing exerts enough force on the first detent member to cause the first detent member to rotate in a second direction causing the second detent member to engage an adjacent detent notch of the first detent member.

To acquaint persons skilled in the art most closely related to the device disclosed herein, embodiments illustrating the best mode now contemplated for putting the invention into practice are described herein by and with reference to, the annexed drawings that form a part of the specification. The exemplary embodiments are described in detail without attempting to show all of the various forms and modifications in which the invention might be embodied. As such, the embodiments shown and described herein are illustrative, and as will become apparent to those skilled in the art, can be modified in numerous ways within the spirit and scope of the invention—the invention being measured by the appended claims and not by the details of the specification.

BRIEF DESCRIPTION OF THE DRAWINGS

For a complete understanding of the objects, techniques, and structure of the invention reference should be made to the following detailed description and accompanying drawings, wherein.

DESCRIPTION OF EXEMPLARY EMBODIMENTS

Figure 1:
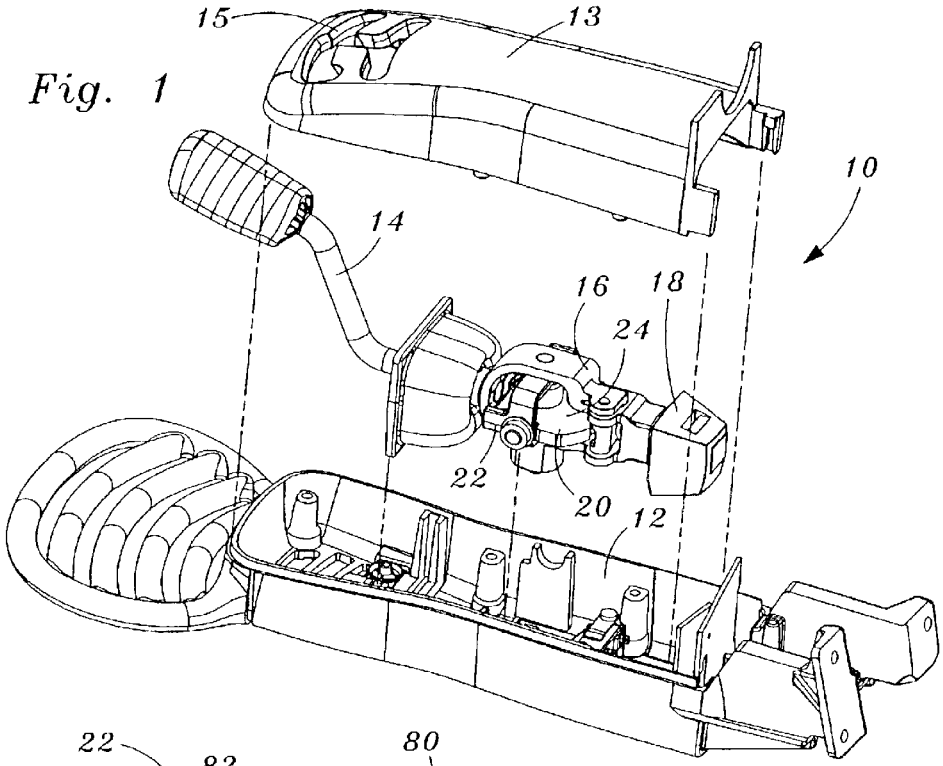
FIG. 1 is an exploded view of the operating lever assembly disclosed herein.
Figure 2:
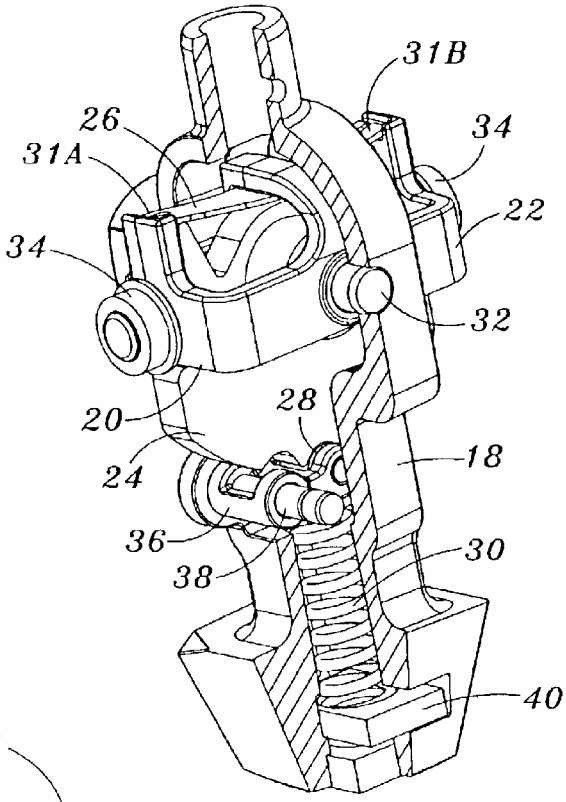
FIG. 2 is a perspective view, partially cut-away, of the actuator assembly of the operating lever assembly.

Referring now to the drawings and particularly to FIGS. 1 and 2, it will be seen that an exemplary embodiment of an operating lever assembly is designated generally by the numeral 10. Operating lever assembly 10 is generally comprised of a main housing 12, a main housing cover 13, a lever 14, and an actuator assembly 16. Actuator assembly 16 is comprised primarily of a detent mechanism 20 located within an actuator housing 18. Lever 14 is operatively connected to the actuator housing 18 which is, in turn, disposed within the main housing 12. Main housing cover 13 includes a lever guide slot 15 through which a portion of lever 14 extends. Detent mechanism 20 comprises a yoke 22, a detent plate 24, a leaf spring 26, a roller 28, and a compression spring 30. Leaf spring 26, as shown in the exemplary embodiment, is a unitary strip having ends 31. Detent plate 24 is rotatably mounted in yoke 22 by way of a main pivot pin 32 while yoke 22 is journaled in the main housing 12 via bearings 34. The actuator housing 18 is also mounted to the yoke 22 by way of main pivot pin 32. Roller 28 is journaled in a roller pivot yoke 36 which is pivotally mounted in the actuator housing 18 by means of a roller pivot pin 38. Compression spring 30 is disposed within the actuator housing 18 between a retaining block 40 and roller pivot yoke 36 so as to apply a biasing force to roller 28.

Figure 3:
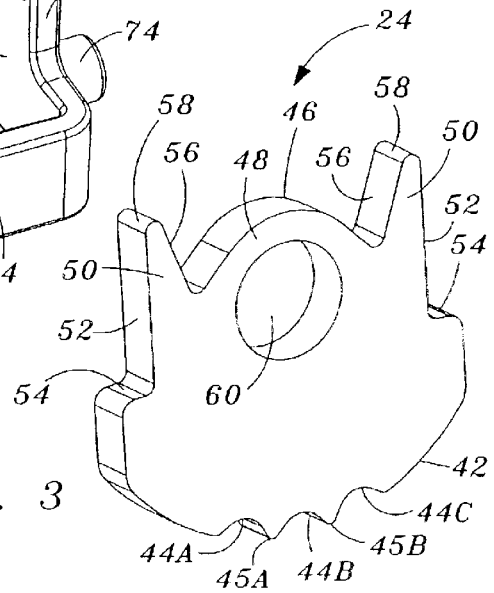
FIG. 3 is a perspective view of the detent plate of the assembly.

As is perhaps best shown in FIG. 3 detent plate 24 has a generally arcuate first edge 42 which is interrupted along its length by a plurality of detent notches 44. Similarly, there are a plurality of apexes 45 formed between each of the adjacent detent notches 44. As will be seen in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus in the exemplary embodiment pictured in the drawing figures, there are three detent notches associated with the detent plate 24. The notches are generally identified by the numeral 44, but the specific, individual notches are, therefore, identified as 44A, 44B, and 44C in the specification and in the drawings. This suffix convention shall be employed throughout the specification.

Detent plate 24 is further characterized by a second edge 46 located opposite first edge 42. Second edge 46 has an arcuate center portion 48 and a pair of legs 50 disposed on either side of center portion 48. As shown in the drawings each leg 50 has a first side 52 which terminates at a land 54 and second side 56 which is disposed at an angle relative to first side 52. The apex at which first side 52 and second side 56 meet, defines a rounded bearing surface 58. Detent plate 24 further includes a bearing aperture 60 adjacent to the arcuate center portion 48.

Figure 4:
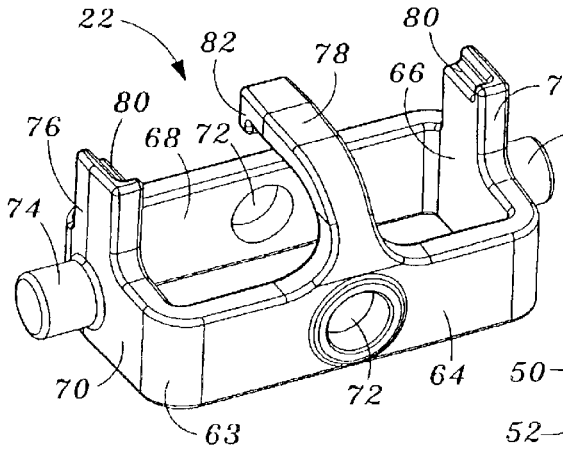
FIG. 4 is a perspective view of the yoke of the assembly.

With reference now to FIG. 4 it will be seen that yoke 22 is characterized by a continuous rectangular main body portion 62. As can be seen main body portion 62 has a first side 64, a second side 66 disposed at a right angle to first side 64, a third side 68 disposed at a right angle to second side 66 and opposite first side 64, and a fourth side 70 is disposed at a right angle to first and third sides 64 and 68 respectively and generally opposite second side 66. First and third sides 64 and 68 respectively include pivot apertures 72 concentrically aligned with one another. Similarly, second and fourth sides 66 and 70 each have a pivot boss 74 extending outwardly there from and oriented on a common axis. The pivot apertures 72 facilitate the pivotal mounting of the detent plate 24 in the yoke 22, while the pivot bosses 74 facilitate the mounting of the yoke within the main housing 12. Means are provided for retaining the leaf spring 26 within the yoke 24. In the illustrated embodiment such means comprise standards 76 extending upwardly from the second and fourth sides 66 and 70 respectively of the main body portion 62, as well as a bolster 78 which extends from first side 64 of main body portion 62. It will further be noted that standards 76 each have a recessed portion 80 therein, for reasons which will become apparent as the detailed description continues. As can be seen bolster 78 extends upwardly and across main body portion 62 toward third side 68 and terminates at a point just beyond the midway point between first side 64 and third side 68. Bolster 78 further includes a tab 82 which extends from the end thereof. When assembled, leaf spring 26 is interposed between the detent plate 24 and the bolster 78 of yoke 22 with the ends 31 thereof being supported in the recessed portions 80 of standards 76. Tab 82 serves to maintain the leaf spring 26 in position, and place the leaf spring 26 in a pre-charged condition.

As can be seen from the drawings detent plate 24 is mounted in the yoke 22 such that the legs 50 are directed toward the leaf spring 26, while the detent notches 44 are positioned proximal to the roller 28 which is mounted by way of the roller pivot yoke 36 to the actuator housing 18. Lands 54 facilitate the mating fit of the detent plate 24 within the yoke 22, but it should be noted that for reasons which will become apparent as the description continues, a certain amount of clearance is necessary between the detent plate 24 and the yoke 22 so as to allow the detent plate 24 to rotate slightly within the yoke 22. Roller 28 is biased against the first edge 42 of detent plate 24 by the compression spring 30 and is capable of operatively engaging the detent notches 44 in response to movement of the lever 14, which in turn pivots the actuator housing 18 relative to the yoke 22 and detent plate 24. Engagement of the detent notches 44 by the spring biased roller 28 serves to maintain the actuator housing 18 in the selected position. Those having skill in the art will recognize that actuator housing 18 may be fitted with electronic sensors and/or mechanical or electromechanical linkages to the device being operated by the assembly 10. For example, it may be desired to utilize the assembly 10 to control a power transmission device. As such the actuator housing 18 may be fitted with a first sensor element, while a plurality of additional sensor elements are fitted to the main housing 12 proximal to the first sensor element such that movement of the actuator housing 18 by way of lever 14 brings the first sensor element into operative communication with a discrete sensor element in the main housing 12. The sensors in the main housing would each serve to detect the selection of a particular desired shift position or the like, and through appropriate logic the power transmission device is controlled to effect the desired shift. Those skilled in the art will recognize that such a device has numerous applications in controlling a wide variety of devices.

Figure 5:
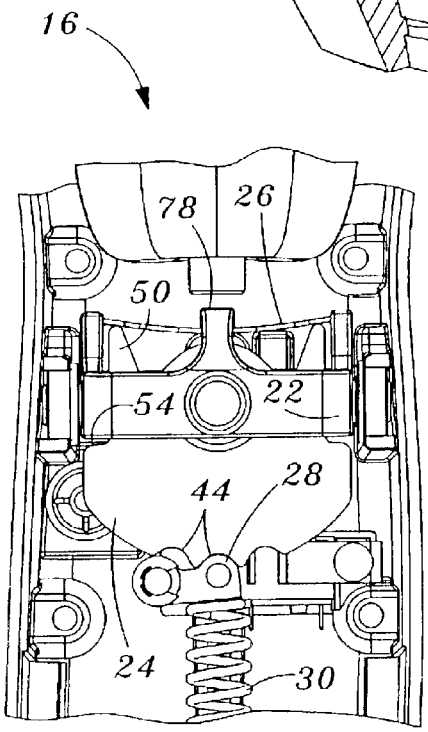
FIG. 5 is an elevational view of the assembly with the detent roller seated in a detent notch; and, FIG. 6 is an elevational view of the assembly showing the detent roller in transition between detent notches.
Figure 6:
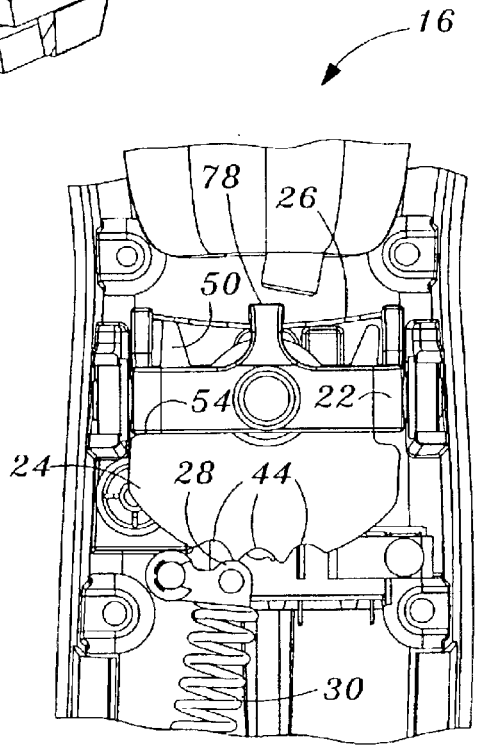

When it is determined to select a particular position for the actuator housing 18 it is desired that the operator be assured that the selected position is positively engaged and maintained. Accordingly, the interaction between the detent plate 24 and the leaf spring 26 serves to prevent perching of the detent mechanism 20 between selected positions as will be more fully set forth below. Referring now to FIGS. 5 and 6, it will be noted that the mounting of the detent plate 24 within the yoke 22 allows the detent plate 24 to pivot within, and relative to, the yoke 22 through a limited range. Accordingly, when the actuator housing 18 is manipulated by way of lever 14, the frictional component between the spring biased roller 28 and the detent plate 24 causes the detent plate 24 to rotate slightly relative to the yoke 22. This limited rotation of the detent plate 24 relative to the yoke 22 is sufficient to bring the bearing surface 58 of one of the legs 50 into engagement with the leaf spring 26. The particular leg 50 which engages the leaf spring 26 is determined by the direction in which the actuator housing 18 is being manipulated. Continued manipulation of the actuator housing 18 in the same direction causes the leg 50 to be biased to a greater degree by the leaf spring 26 until one of the lands 54 contacts the yoke 22. Further manipulation of actuator housing 18 in the same direction now causes the roller 28 to become unseated from the bottom of the detent notch 44 in which it is seated and starts to climb the side of the detent notch 44, against which it is biased. As the roller 28 approaches an apex 45 between detent notches 44, where perching is most likely to occur due to a force balance condition, the bias force being applied to the leg 50 of detent plate 24 by the leaf spring 26 is sufficient to rotate the detent plate 24 in the opposite direction relative to yoke 22, thereby causing roller 28 to snap into position in the adjacent detent notch 44. Thus the force balance condition is minimized and the desired position is positively engaged and maintained without perching between positions.

The magnitude of rotation of the detent plate 24 in both directions, is found by determining the total frictional loss torque of the system. The greatest loss is due to side loading between the lever 14 and the lever guide slot 15. This frictional loss torque can be determined by considering the magnitude of the side load, the distance of the lever loading point from the pivot center, and the coefficient of friction between the lever material and the guide material. At a minimum this frictional loss torque needs to be overcome to avoid the undesirable force balance situation. This frictional loss torque then dictates the minimum torque needed by the detent mechanism to resist lever movement at all times prior to the point at which the detent roller 28 reaches an apex 45. After the detent roller 28 reaches an apex 45, the mechanism should encourage lever movement with a torque which is at a minimum, the magnitude of the frictional loss torque so as to prevent a force balance situation.

The geometry of the angle of the detent notches 44 relative to the detent roller 28, and the force on the detent roller 28 from the detent spring determines the torque from the mechanism. The angle of the detent roller 28 relative to the adjacent apex 45 at the point where the torque from the mechanism is equal to the frictional loss torque is thus the minimum angle required for oscillation of the detent plate 24 in either direction, in order to achieve proper operation of the assembly.

The torque generated by the leaf spring 26 and applied to the detent plate 24 always needs to be smaller than the torque generated by the detent roller 28 and detent roller spring 30 in order to secure proper functioning of the assembly 16. This will ensure that the leaf spring 26 is fully charged and the detent plate 24 has rotated the full amount within the limited rotational range allowed by the lands 54 relative to the yoke 22, before the roller 28 starts to climb one side of detent notch 44. On the other hand the leaf spring 26 should be of the maximum strength possible within the guidelines stated above so as to make the function of the assembly 16 as crisp as possible.

The mounting of the leaf spring 26 in the recessed portions 80 of standards 76 is maintained due to the fact that the leaf spring 26 is interposed between the detent plate 24 and the bolster 78. As such, each end 31 of the leaf spring 26 is free to flex within a limited range according to the movement of the detent plate 24, while the leaf spring 26 is positively maintained in the yoke 22 by the bolster 78 without the need for additional fasteners or the like.

The interaction between the detent plate 24 and the leaf spring 26 not only assures engagement of the roller 28 in the appropriate detent notch 44 and retains the selected position despite vibration, but also provides a positive sound and feel feedback to the operator due to the snap action of the detent mechanism as the roller 28 engages one of the detent notches 44. Thus when an operating position is selected the operator is positively assured that the desired position has been attained.

Those skilled in the art will recognize that a variety of equivalent structures may be utilized in lieu of those described in detail herein. For example the roller may be in the form of a cylindrical or non-cylindrical roller having a generally square cross section with rounded corners. The roller may also be in the form of a ball or merely a fixed surface capable of sliding engagement with the detent plate, there being a variety of shapes which will accomplish the purpose. Similarly, a variety of means may be utilized to bias the detent plate other than the leaf spring described herein. For example it is possible to utilize other types of springs such as coil springs or torsion springs as well as non-spring bias means such as elastomers, hydraulic or pneumatic devices. In the event that other types of structures are chosen in substitution for the described structures certain modifications to other described structures may be necessary. For example if a different type of biasing means is provided modification of the yoke and detent plate may be necessary. Further those skilled in the art will recognize that the detent notches could be substituted by equivalent structures such as raised bumps or tabs. All such substitutions and/or modifications are within the scope of the invention as claimed.

While in accordance with the patent statutes, only the best mode and exemplary embodiments of the invention have been presented and described in detail, such is not intended to be exhaustive or to limit the invention to the precise form disclosed. Obvious modifications or variations are possible in light of the above teachings. The embodiments were chosen and described to provide the best illustration of the principles of the invention and its practical application, to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

The embodiments of the invention in which an exclusive property or privilege is claimed are defined as follows:

1. A detent mechanism for an operating device assembly comprising:

a detent housing;

a first detent member having a plurality of adjacent detent notches therein with an apex between adjacent detent notches, the first detent member being rotatably disposed within the detent housing;

means for biasing the first detent member against rotation; and, a second detent member frictionally engaging the first detent member, the second detent member being capable of movement relative to the first detent member and of selectively engaging the detent notches of the first detent member;

whereby movement of the second detent member causes the first detent member to rotate in a first direction until the means for biasing exerts enough force on the first detent member to limit rotation of the first detent member in the first direction allowing the second detent member to move relative to the first detent member thereby unseating the second detent member from a detent notch and allowing the second detent member to move onto an apex between detent notches at which time the means for biasing exerts enough force on the first detent member to cause the first detent member to rotate in a second direction so as to cause the second detent member to engage an adjacent detent notch of the first detent member.

2. A detent mechanism for an operating device assembly according to claim 1 wherein the means for biasing is a leaf spring.

3. A detent mechanism for an operating device assembly according to claim 1 wherein the second detent member is a roller frictionally biased against the first detent member.

4. A detent mechanism for an operating device assembly according to claim 3 wherein the roller is a cylindrical roller.

5. A detent mechanism for an operating device assembly according to claim 3 wherein the roller is a ball.

6. A detent mechanism for an operating device assembly according to claim 1 wherein the detent housing comprises a yoke, the yoke having a pair of standards and a bolster.

7. A detent mechanism for an operating device assembly according to claim 1 wherein the first detent member is a plate having a pair of leg members extending there from.

8. A detent mechanism for an operating device assembly according to claim 7 wherein the means for biasing is a leaf spring having first and second ends, the leaf spring being interposed between the bolster of the yoke and the first detent member with the ends thereof supported in the standards of the yoke.

9. A detent mechanism for an operating device assembly according to claim 8 wherein the roller is a cylindrical roller.

10. A detent mechanism for an operating device assembly according to claim 8 wherein the roller is a ball.

11. A detent mechanism for an operating lever assembly comprising:

a spring;

a detent plate having at least two legs extending there from and a plurality of adjacent detent notches therein with an apex between adjacent detent notches, the detent plate being disposed for limited rotational movement relative to the spring; and, a detent element biased against the detent plate, the detent element being capable of movement relative to the detent plate;

whereby movement of the detent element causes limited rotational movement of the detent plate relative to the spring in a first direction bringing one of the legs into biased engagement with the spring until as the detent element approaches the apex between adjacent detent notches the bias force exerted upon the leg by the spring rotates the detent plate in an opposite direction causing the detent element to engage an adjacent detent notch.

12. A detent mechanism for an operating lever assembly according to claim 11 wherein the spring is a leaf spring.

13. A detent mechanism for an operating lever assembly according to claim 11 wherein the frictional detent element is a roller frictionally biased against the first detent member.

14. A detent mechanism for an operating device assembly according to claim 13 wherein the roller is a cylindrical roller.

15. A detent mechanism for an operating device assembly according to claim 13 wherein the roller is a ball.

16. A detent mechanism for an operating lever assembly comprising:

a main housing;

a yoke mountably disposed within the main housing the yoke having a pair of standards and a bolster;

a detent plate rotatably disposed within the yoke, the detent plate having at least two legs extending there from and a plurality of adjacent detent notches therein with an apex between the adjacent detent notches;

a leaf spring supported by the standards of the yoke and interposed between the bolster of the yoke and the detent plate; and, a roller frictionally biased against the detent plate in the vicinity of the plurality of adjacent detent notches, the roller being capable of selective movement relative to the detent plate so as to enable the roller to frictionally engage individual detent notches;

whereby movement of the roller causes the detent plate to rotate in a first direction within the yoke, bringing one of the legs of the detent plate into contact with the leaf spring such that continued rotation of the detent plate in the first direction causes the leaf spring to bias the detent plate in a second direction until as the roller unseats from a detent notch and approaches an apex between adjacent detent notches the leaf spring forces the detent plate in the second direction causing the roller to engage an adjacent detent notch.

17. A detent mechanism for an operating lever assembly according to claim 16 wherein the roller is a cylindrical roller.

18. A detent mechanism for an operating lever assembly according to claim 16 wherein the roller is a ball.

19. An operating lever assembly comprising:

a main housing;

a yoke mountably disposed within the main housing, the yoke having a pair of standards and a bolster;

an actuator housing pivotally mounted to the yoke and movably disposed within the main housing;

an operating lever operatively connected to the actuator housing;

a detent plate rotatably mounted in the yoke, the detent plate having a pair of legs and a plurality of adjacent detent notches with an apex between each of the adjacent detent notches;

a leaf spring having first and second ends, the leaf spring being interposed between the detent plate and the bolster of the yoke with the ends thereof being supported by the standards of the yoke;

a roller pivotally mounted in the actuator housing, the roller being disposed for selective engagement of the detent notches of the detent plate;

a compression spring disposed within the actuator housing, the compression spring frictionally biasing the roller against the detent plate;

whereby manipulation of the lever causes the actuator housing to move and also causes the detent plate to begin to rotate in a first direction due to the frictional engagement of the roller as the roller is being unseated from a detent notch, bringing one of the legs of the detent plate into engagement with the leaf spring such that continued rotation of the detent plate causes the leaf spring to bias the detent plate in a second direction until as the roller approaches an apex between adjacent detent notches the leaf spring forces the detent plate in the second direction thereby causing the roller to nest in an adjacent detent notch.

20. An operating lever assembly according to claim 19 wherein the roller is a cylindrical roller.

21. An operating lever assembly according to claim 19 wherein the roller is a ball.

22. An operating lever assembly comprising:

a main housing;

a yoke mountably disposed within the main housing, the yoke having a pair of standards and a bolster;

an actuator housing pivotally mounted to the yoke and movably disposed within the main housing;

an operating lever operatively connected to the actuator housing;

a detent plate mounted for limited rotational movement within the yoke, the detent plate having a pair of legs and a plurality of adjacent detent notches with an apex between each of the adjacent detent notches;

a leaf spring having first and second ends, the leaf spring being interposed between the detent plate and the bolster of the yoke with the ends thereof being supported by the standards of the yoke;

a roller pivotally mounted in the actuator housing, the roller being disposed for selective engagement of the detent notches of the detent plate;

a compression spring disposed within the actuator housing, the compression spring frictionally biasing the roller against the detent plate;

whereby manipulation of the lever causes the actuator housing to move and also causes the detent plate to begin to rotate in a first direction through a limited range due to the frictional engagement of the roller, bringing one of the legs of the detent plate into engagement with the leaf spring such that continued rotation of the detent plate causes the leaf spring to bias the detent plate in a second direction until as the roller is unseated from a detent notch and approaches an apex between adjacent detent notches the leaf spring forces the detent plate in the second direction thereby causing the roller to nest in an adjacent detent notch.

23. An operating lever assembly according to claim 22 wherein a torque generated by the leaf spring and applied to the detent plate is smaller than a torque generated by the detent roller and the compression spring.

24. An operating lever assembly according to claim 23 wherein the roller is a cylindrical roller.

25. An operating lever assembly according to claim 23 wherein the roller is a ball.

* * * * *